US007380359B2

(12) United States Patent
Mainetti

(10) Patent No.: US 7,380,359 B2
(45) Date of Patent: Jun. 3, 2008

(54) INDICATOR BLOCK AND SUPPORT

(75) Inventor: Mario Mainetti, Valdagno (IT)

(73) Assignee: Mainetti S.p.A., Via Casarette (IT)

( * ) Notice: Subject to any disclaimer, the term of this patent is extended or adjusted under 35 U.S.C. 154(b) by 289 days.

(21) Appl. No.: 10/767,097

(22) Filed: Jan. 29, 2004

(65) Prior Publication Data

US 2004/0181986 A1 Sep. 23, 2004

(51) Int. Cl.
*A41D 27/22* (2006.01)

(52) U.S. Cl. ..... 40/322; 223/85

(58) Field of Classification Search ..... 40/322, 40/648, 666, 316; 223/85; 24/DIG. 51; 292/DIG. 61, 303, 152
See application file for complete search history.

(56) References Cited

U.S. PATENT DOCUMENTS

| | | | | | |
|---|---|---|---|---|---|
| D192,845 | S | | 5/1962 | Cohen | D1/3 |
| 3,535,808 | A | | 10/1970 | Morrish | 40/322 |
| 3,552,702 | A | * | 1/1971 | Springer | 248/316.7 |
| 3,906,957 | A | * | 9/1975 | Weston | 606/205 |
| 3,949,914 | A | | 4/1976 | Ostroll | 223/85 |
| 4,101,059 | A | | 7/1978 | Batts et al. | 223/85 |
| 4,115,940 | A | | 9/1978 | Phillips | 40/322 |
| 4,268,986 | A | * | 5/1981 | Piana | 40/316 |
| 4,322,902 | A | | 4/1982 | Lenthall | 40/322 |
| 4,363,180 | A | * | 12/1982 | Lucas et al. | 40/316 |
| 4,450,639 | A | | 5/1984 | Duester | 40/322 |
| 4,997,114 | A | | 3/1991 | Petrou | 223/85 |
| 5,096,101 | A | | 3/1992 | Norman et al. | 223/85 |
| 5,305,933 | A | | 4/1994 | Zuckerman | 223/85 |
| 5,388,354 | A | | 2/1995 | Marshall et al. | 40/322 |
| 5,407,109 | A | | 4/1995 | Zuckerman | 223/85 |
| 5,441,182 | A | | 8/1995 | Sullivan | 223/85 |
| 5,469,995 | A | | 11/1995 | Bredeweg et al. | 223/85 |
| 5,477,995 | A | | 12/1995 | Dooley et al. | 223/85 |
| 5,503,310 | A | | 4/1996 | Zuckerman et al. | 223/85 |
| 5,573,151 | A | | 11/1996 | Fildan | 223/96 |
| 5,590,822 | A | | 1/1997 | Zuckerman | 223/85 |
| 5,597,100 | A | | 1/1997 | Blitz | 223/85 |
| 5,603,437 | A | | 2/1997 | Zuckerman | 223/85 |
| 5,611,469 | A | | 3/1997 | Eiley et al. | 223/85 |
| 5,641,100 | A | | 6/1997 | Mitchell et al. | 223/85 |
| 5,642,840 | A | | 7/1997 | Abdi | 223/85 |
| 5,683,018 | A | | 11/1997 | Sullivan et al. | 223/85 |
| 5,687,887 | A | | 11/1997 | Bond et al. | 223/85 |
| 5,775,553 | A | | 7/1998 | Marshall et al. | 223/85 |
| 5,819,995 | A | | 10/1998 | Zuckerman | 223/85 |
| 5,857,276 | A | | 1/1999 | Marshall et al. | 40/322 |
| 5,913,462 | A | | 6/1999 | Petrou | 223/85 |
| 5,950,883 | A | | 9/1999 | Bond et al. | 223/85 |
| 6,019,260 | A | | 2/2000 | Gouldson | 223/85 |

(Continued)

*Primary Examiner*—Cassandra Davis
(74) *Attorney, Agent, or Firm*—Francis C. Hand; Carella, Byrne, Bain et al.

(57) ABSTRACT

A hanger is provided with a web with an internally disposed tab for movement in the plane of the web between a first position and a second position. A size indicator that is mounted on the web has a pair of walls disposed on opposite sides of the web and a bridge that extends between the walls for locking engagement with the tab in the first position. In one embodiment, the end of the tab may be accessed by a pointed tool to allow the block to be removed. In another embodiment, the tab is covered over to prevent the block from being removed. Several seating arrangements are provided for seating of the block on the web.

35 Claims, 16 Drawing Sheets

U.S. PATENT DOCUMENTS

| | | | | |
|---|---|---|---|---|
| 6,029,868 | A | 2/2000 | Willinger et al. | 223/85 |
| 6,041,983 | A | 3/2000 | Sullivan et al. | 223/85 |
| 6,145,713 | A | 11/2000 | Zuckerman | 223/85 |
| 6,189,746 | B1 | 2/2001 | Gouldson | 223/85 |
| 6,264,075 | B1 | 7/2001 | Gouldson et al. | 223/85 |
| 6,499,633 | B1 | 12/2002 | Pogmore | 223/85 |
| 6,523,240 | B1 | 2/2003 | Gouldson | 29/403.1 |
| 2002/0184799 | A1 | 12/2002 | Chou | 40/322 |
| 2002/0190090 | A1 | 12/2002 | Gouldson | 223/85 |
| 2003/0019137 | A1 | 1/2003 | Giustini et al. | 40/322 |

* cited by examiner

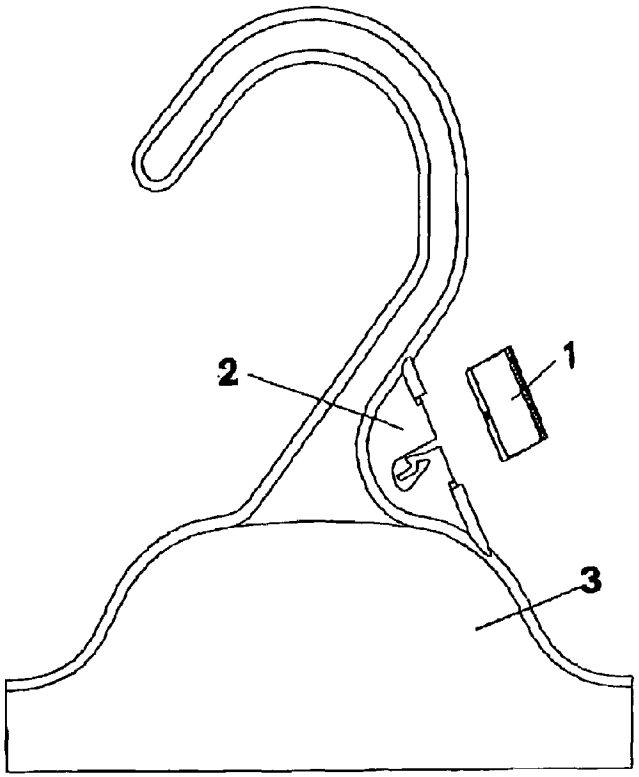
FIG.26
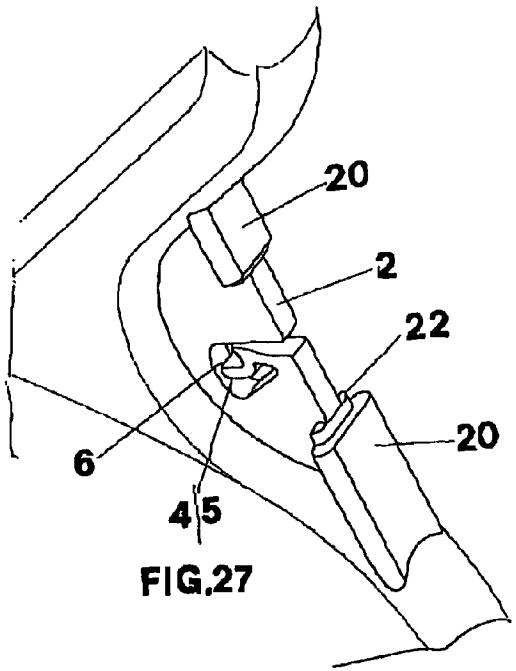
FIG.27
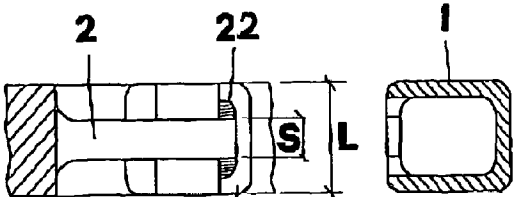
FIG.29
FIG.28

30
11
16.1
14.3
2
7
6
4

11
6
14.3
4

30
11
16.1
7
10
14.3
4

30
11
16.1
14.3
2
6
4
7

11
4
6
14.3

30
11
16.1
7
10
4
10
14.3
4

INDICATOR BLOCK AND SUPPORT

This invention relates to an indicator block and a support. More particularly, this invention relates to a size indicator for a hanger. Still more particularly, this invention relates to a hanger and a size indicator mounted on the hanger.

The use of small indicator blocks that are applied to products in order to identify them is well known in many industries, particularly in the trade field, for example in the garment industry.

The small indicator blocks of the known type have the drawback of being easily removed from their attachment seat. This removal easiness means having some objects without the small indicator block and makes possible exchanges of goods easy by ill-disposed people during the handling of goods in warehouses or in stores particularly where the small indicator block is applied on coat hangers or garment bags in general with size-mark functions.

Moreover, as coat hangers are commonly used at home, if the size indicator block is easily removable, there is a risk that small children may use the block as a toy. Further, due to their typically small sizes and bright colors, these indicator blocks could be mistaken for a sweet and therefore dangerously swallowed.

It is an object of the present invention to provide a small indicator block that after having been assembled on a support prevents these negative events from occurring.

It is another object of the invention to provide a size indicator block that may be locked on a hanger.

It is another object of the invention to provide a size indicator block that may be locked on a hanger and that requires a specific type of tool to be removed.

It is another object of the invention to provide a size indicator block that has large surface areas to receive printing or other indicia.

It is another object of the invention to provide a small indicator block that can be easily and quickly applied both manually and automatically on the web of the support.

It is another object of the invention to provide a small indicator block that can be produced by a simple molding of plastic material.

Briefly, the invention provides a combination of a hanger having a web with at least one internally disposed tab for movement in the plane of the web between a first position and a second position and a size indicator that is mounted on the web. The size indicator has a pair of walls disposed on opposite sides of the web and means extending from at least one of the walls for locking engagement with the tab in the first position.

While the size indicator is specifically intended for use on a hanger, the indicator may be mounted on any support having a web as described above and may be used to indicate information other than a size of an article on the support.

In one embodiment, an indicator block is provided that has a pair of spaced apart walls defining an opening therebetween, a cover connecting the walls at one end thereof and at least one bridge connected to and extending between the walls in spaced relation to the cover. In this embodiment, the walls are typically disposed in parallel relation to each other and in perpendicular relation to the cover. Also, each of the walls and the cover has a flat surface for receiving printing, for example, in Arial font. In this respect, the walls and cover of the indicator block present large flat surface areas for the printing of indicia, such as, the size of a garment. By way of example, each wall has flat surface with a length of 18.2 millimeters and a width of 10.5 millimeters while the cover has a flat surface a length of 18.2 millimeters and a width of 8.6 millimeters.

The means on the indicator block for locking engagement with the tab on the web of the support is in the form of a bridge that extends between the two walls. In one embodiment, the indicator block has a pair of flanges, each of which is integral with a wall and which is disposed in facing relation to the other flange. The bridge extends either between these flanges or between the walls behind the flanges. In either case, the bridge adds to the stiffness of the indicator block. Stiffening ribs may also be employed within the block to further stiffen the block.

The web on which the indicator block is mounted includes a space or opening into which the tab projects. This space is also open so that the bridge on the indicator block may pass into the space while the sides of the block move over the outside surfaces of the web. The tab is of a resilient nature to be pivoted from the first position out of the path of the bridge as the bridge passes by to the second position and to snap back to the first position after passage of the bridge. In this respect, the tab is shaped with a shoulder that abuts the bridge in the second position to lock the indicator block on the web and to prevent the indicator block from being removed from the web.

In one embodiment, the walls of the indicator block and the tab on the web are sized relative to each other such that the walls cover over the tab completely. Thus, a permanent locking of the indicator on the web takes place.

In another embodiment, the tab projects beyond the walls whereby insertion of a pointed tool perpendicularly into the space in the web and against the tab causes movement of the tab from said first position to the second position for unlocking of the indicator block. Once the tab has been moved into the second or unlocking position, the indicator block may be removed from the web with the bridge passing out of the space in the web.

In still another embodiment, the indicator block is made with an internally disposed transverse stiffening that rib has an aperture to receive the locking tab of the web therein. In this embodiment, the bridge is integral with the rib and defines a side of the aperture.

In still another embodiment, the indicator block may have portions thereof made of different materials from the other portions. Also, the web may have a pair of tabs disposed in opposed relation within the space with the bridge of the indicator block received between the tabs.

The support may also have one or more pair of ribs mounted on the web for guiding of the block therebetween and a pair of keys, each of which extends from a respective rib and which has a wall of the indicator block slidably mounted thereon. Instead of using keys at the ends of the ribs, a pair of strips may extend from a rib along the web to slidably mount a wall of the indicator block thereon.

Once the small indicator block has been assembled on the support, the indicator block is firmly fixed in place and requires a specific procedure for which an operator needs to use a specific tool to remove the indicator block and one which would be difficult for a small child to determine.

The small indicator block may be fixedly assembled on the support so that the block can be removed only with an operation that jeopardizes the integrity of the block and thus does not allow reuse.

The small indicator block is made of a substantially parallelepiped box-shaped body with a longitudinal opening on one side surface which allows fitting onto a thin web formed on the support and with a bridge extending between the walls of the block to pass through the space in the web into contact with the counteracting resilient tab formed on the thin web in order to carry out the required attachment.

When a removal operation of the small block without jeopardizing its integrity is required, this operation can be carried out due to the fact that when the indicator block is assembled on the support body, a portion of the resilient tab projects from the block thus allowing an operator to act on this tab portion in order to carry out the required release.

During assembly, the small indicator block is at first brought close to and then fitted onto the thin web by hand or by mechanical means so that the bridge of the block enters into the space containing the tab. The bridge then slightly deforms the tab by pushing the tab laterally to one side. After the bridge passes by, the tab being slightly resilient, springs back into the initial position in order to form an abutment step. This step blocks the bridge from moving back out of the space in the web. The required attachment of the small indicator block on the fixed body is therefore obtained.

In order to remove the small indicator block from the fixed web, the operator needs to operate with a suitably shaped tool, such as a pin or other small-sized and small thickness sharpened tool, on the small portion of the tab that projects from the small block. By exerting pressure on the tab, the tab is slightly deformed as much as required in order to release the bridge from the tab and therefore allow removal of the block from the fixed web.

The features of the small indicator block and of the web on the fixed support will become clear from the following description taken in conjunction with the accompanying drawings wherein:

FIG. 26 illustrates an exploded view of a modified hanger and the indicator block of FIG. 1;

FIG. 27 illustrates a partial perspective view of the hanger of FIG. 26;

FIG. 28 illustrates a cross-sectional view of the web of the hanger of FIG. 26 relative to the cross-section of the indicator block of FIG. 26;

FIG. 29 illustrates a cross-sectional view of the web of the hanger of FIG. 26 with the indicator block of FIG. 26 mounted in place;

Figure 2:
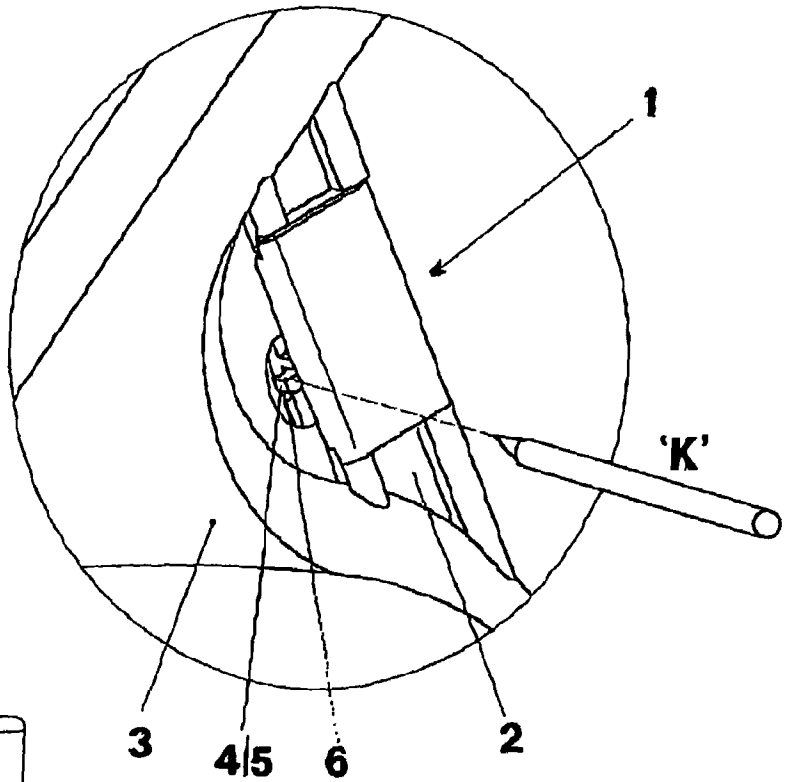
FIG. 2 illustrates an enlarged view of the indicator block and locking tab during a removal operation employing a pointed tool.
Figure 1:
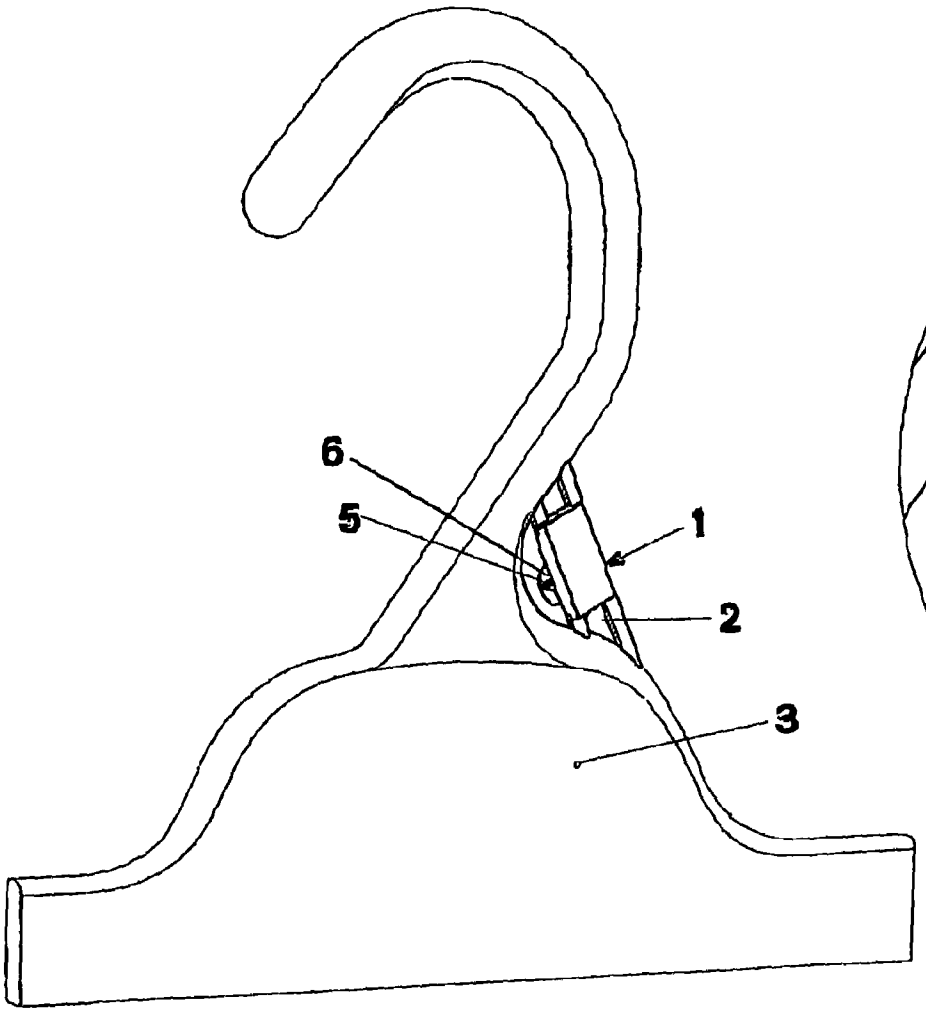
FIG. 1 illustrates a detailed perspective view of a coat hanger equipped with a small indicator block of the type that is assembled in a removable manner in accordance with the invention.
Figure 3:
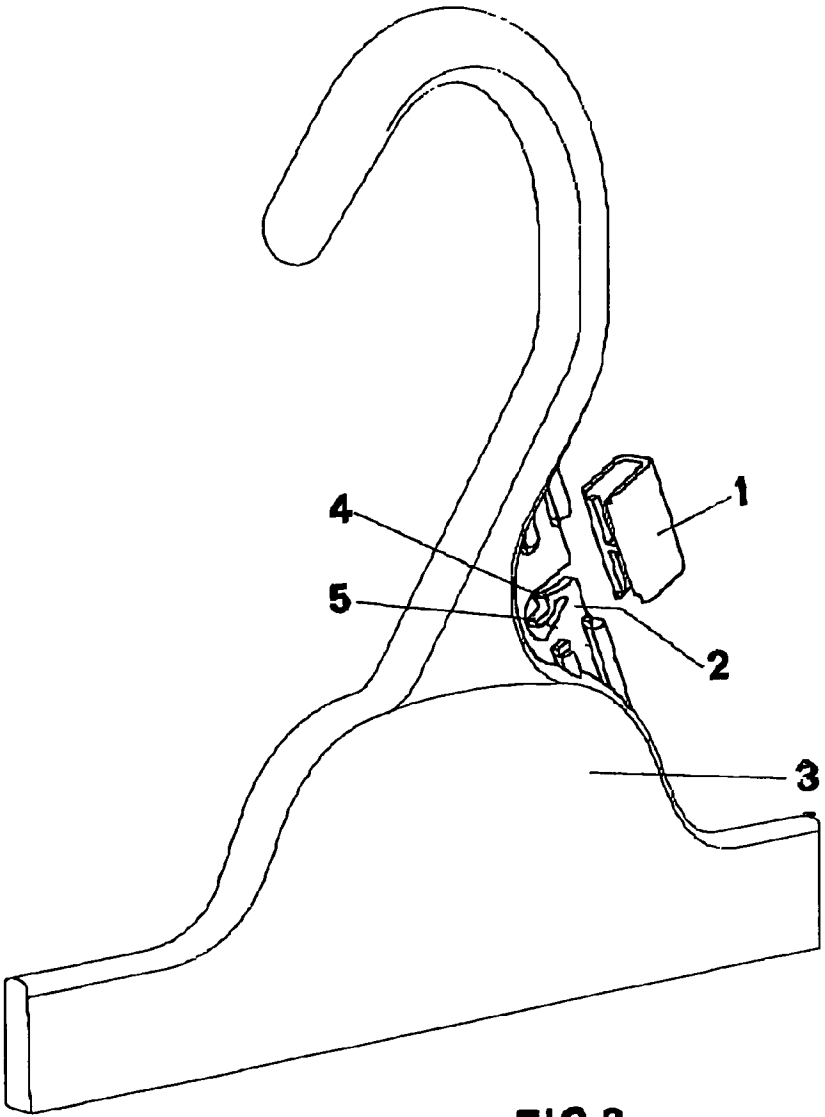
FIG. 3 illustrates an exploded perspective view of the indicator block and hanger of FIG. 1.
Figures 4, 5, 6, 7, 8:
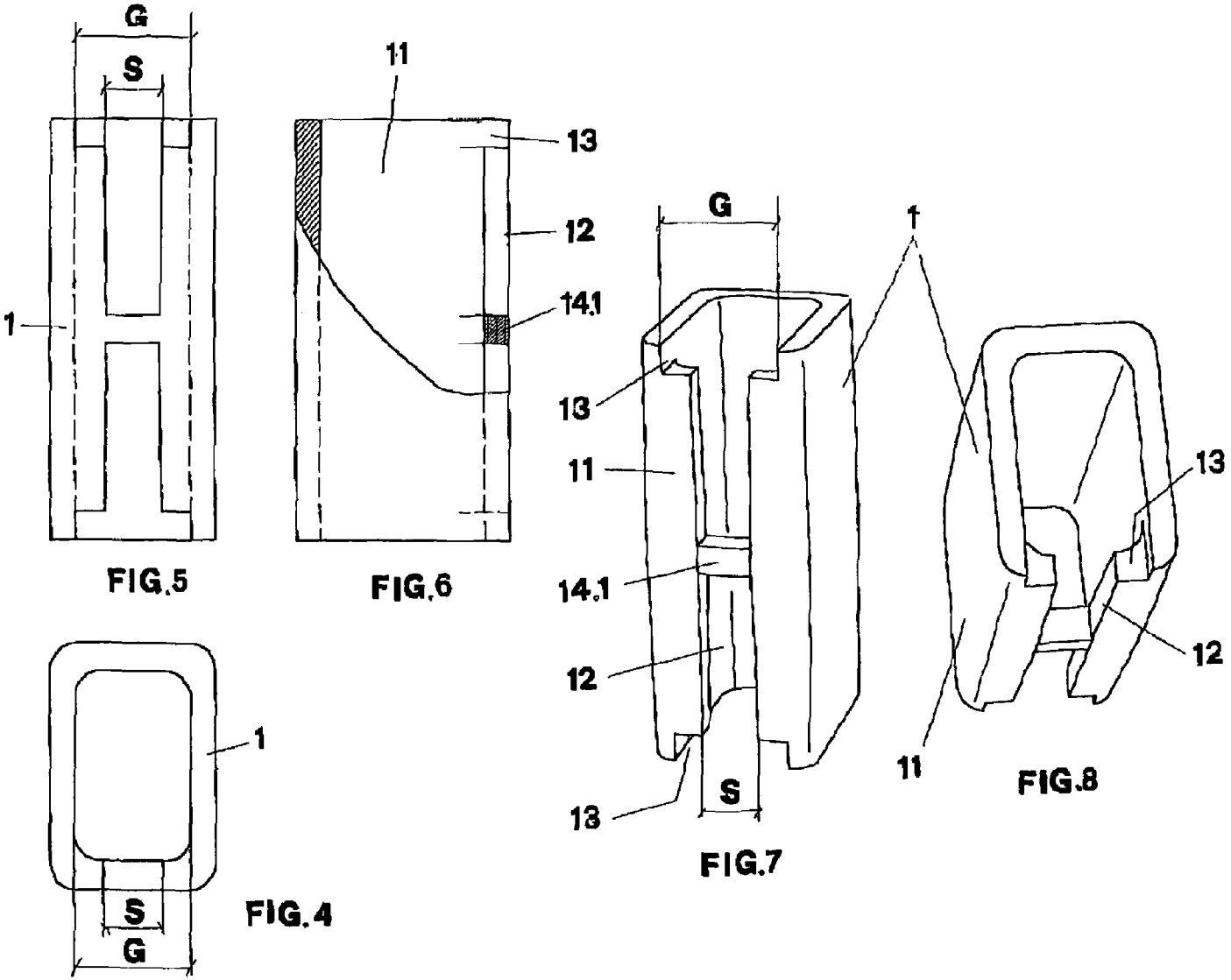
FIG. 4 illustrates an end view of the indicator block of FIG. 1.
FIG. 5 illustrates a top view of the indicator block of FIG. 1.
FIG. 6 illustrates a partial broken away side view of the indicator block of FIG. 1.
FIG. 7 illustrates a perspective view of the indicator block of FIG. 1.
FIG. 8 illustrates a further perspective view of the indicator block of FIG. 1.
Figures 9, 10, 11, 12, 13:
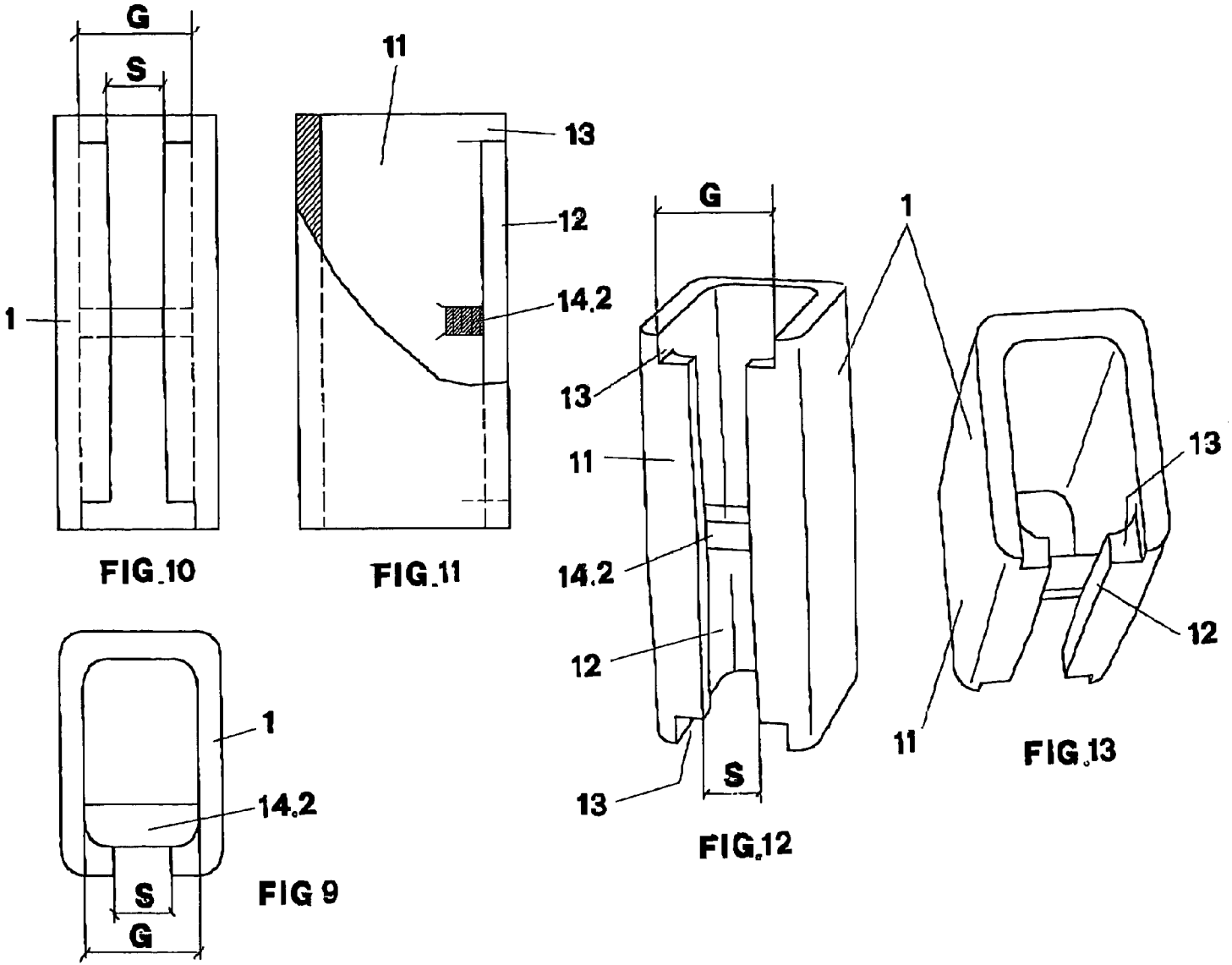
FIG. 9 illustrates an end view of modified indicator block in accordance with the invention.
FIG. 10 illustrates a top view of the indicator block of FIG. 9.
FIG. 11 illustrates a partial broken away side view of the indicator block of FIG. 9.
FIG. 12 illustrates a perspective view of the indicator block of FIG. 9.
FIG. 13 illustrates a further perspective view of the indicator block of FIG. 9.

Referring to FIGS. 1 to 3, the small indicator block 1 is mounted on a thin web 2 formed on a support 3 in the form of a plastic coat hanger.

As shown in FIG. 3, the web 2 has a space or opening 6 therein that is open to the outer edge of the web 2 and at least one resilient tab 4 that extends into the space 6 for movement in the plane of the web 2 between a first position and a second position. When the indicator block 1 is mounted on the web 2, an end 5 of the tab 4 extends beyond the plane of the indicator block 1.

As can be seen in FIGS. 4 to 8, the small indicator block 1 is made of a hollow body 11 whose shape is a substantially right parallelepiped with a longitudinal slot 12 on one of the sides of its lateral surface that develops for the whole height of the block and whose width "S" corresponds to the thickness of the thin web 2 on the support 3.

The block 1 has a pair of spaced apart walls defining an opening, a cover that connects the walls at one end thereof and at least one bridge 14.1 connected to and extending between the walls in spaced relation to the cover. The walls are disposed in parallel relation to each other and in perpendicular relation to the cover. In addition, the block 1 has a pair of flanges, each of which is integral with a wall and extends perpendicularly from the wall toward the other flange. As shown, the bridge 14.1 extends between flanges.

Figure 23:
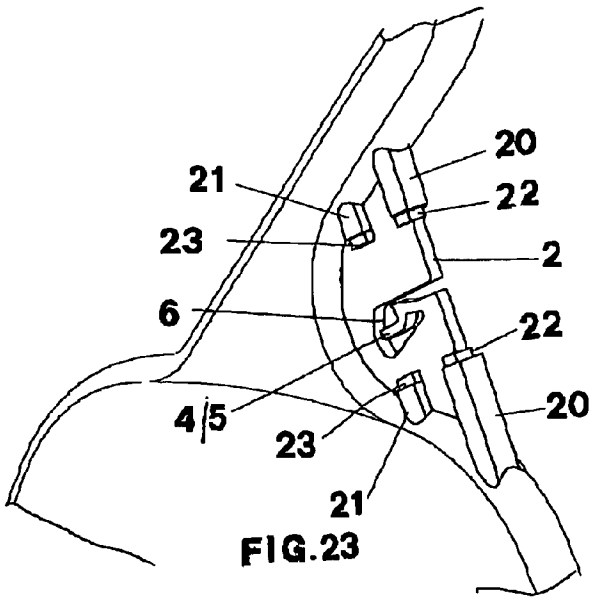
FIG. 23 illustrates a partial perspective view of the hanger of FIG. 1.
Figure 24:
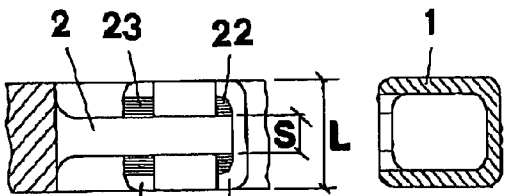
FIG. 24 illustrates a cross-sectional view of the web of the hanger of FIG. 22 relative to the cross-section of the indicator block of FIG. 1.
Figure 25:
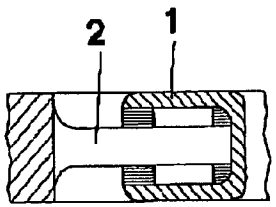
FIG. 25 illustrates a cross-sectional view of the web of the hanger of FIG. 22 with the indicator block of FIG. 1 mounted in place.
Figure 31:
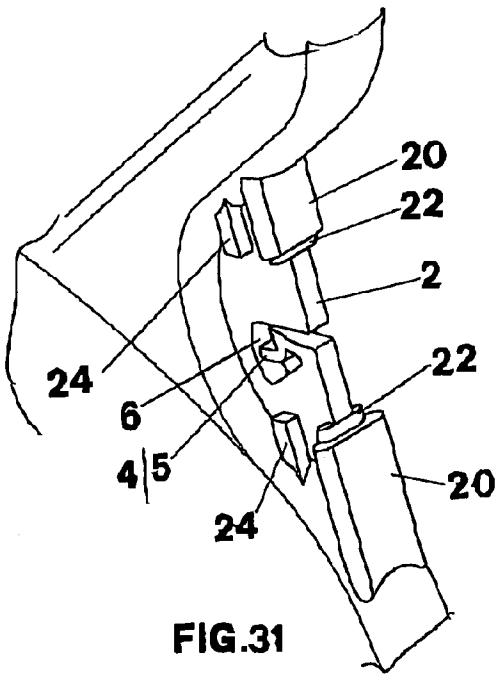
FIG. 31 illustrates a partial perspective view of the hanger of FIG. 30.
Figure 33:
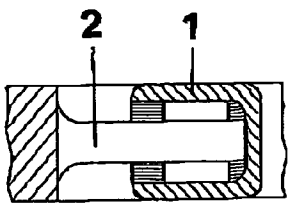
FIG. 33 illustrates a cross-sectional view of the web of the hanger of FIG. 30 with the indicator block of FIG. 30 mounted in place.
Figure 30:
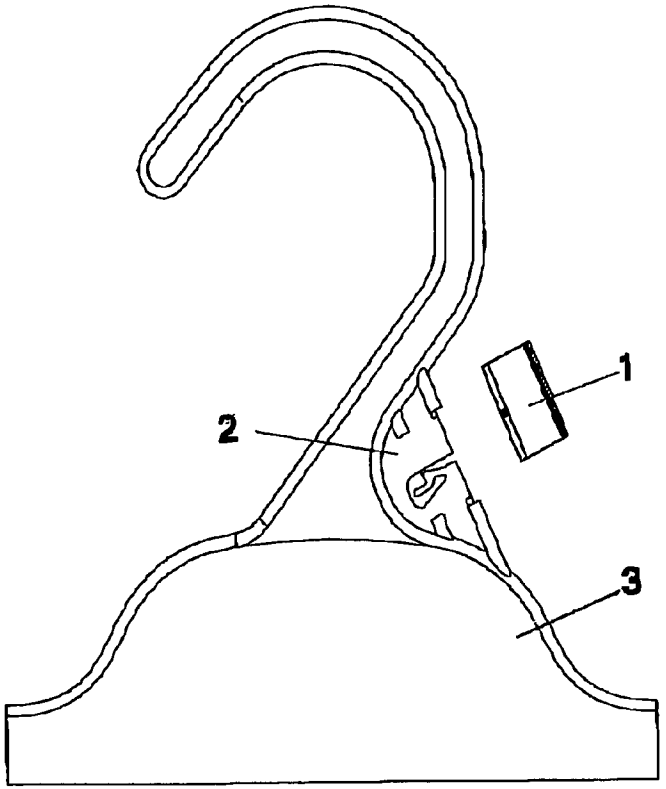
FIG. 30 illustrates an exploded view of a further modified hanger and the indicator block of FIG. 1.
Figure 32:
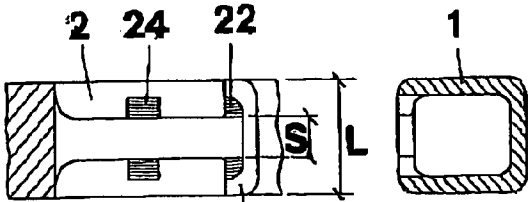
FIG. 32 illustrates a cross-sectional view of the web of the hanger of FIG. 30 relative to the cross-section of the indicator block of FIG. 30.
Figure 34:
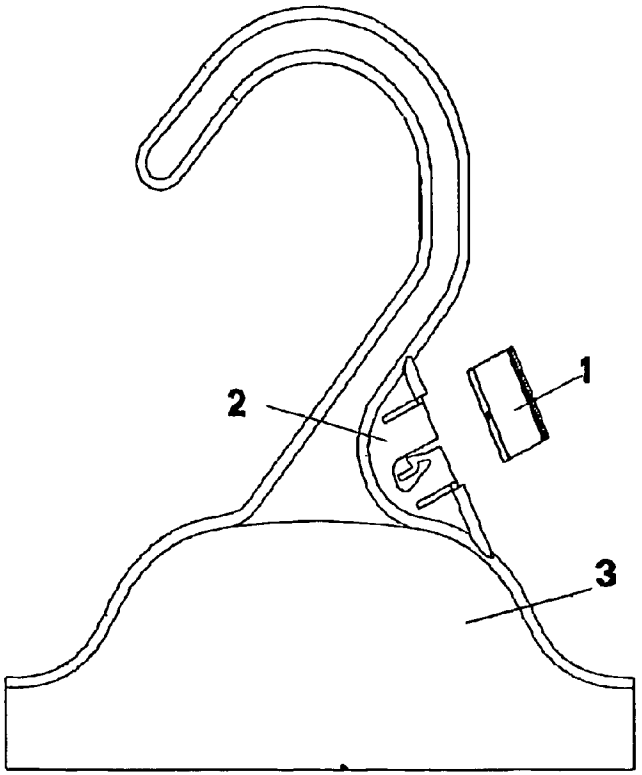
FIG. 34 illustrates an exploded view of a further modified hanger and the indicator block of FIG. 1.
Figure 35:
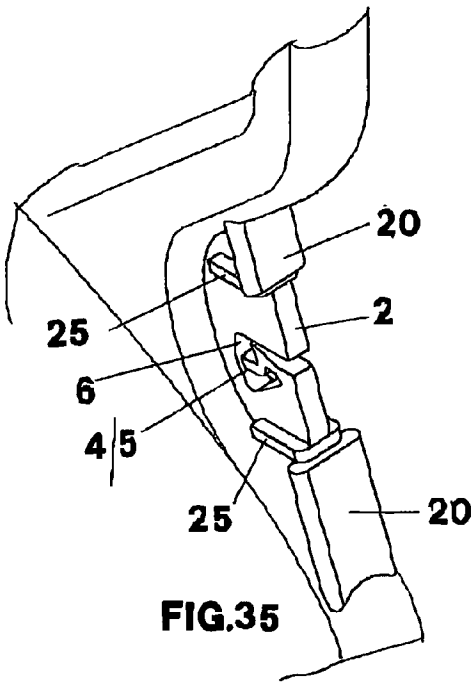
FIG. 35 illustrates a partial perspective view of the hanger of FIG. 34.
Figure 36:
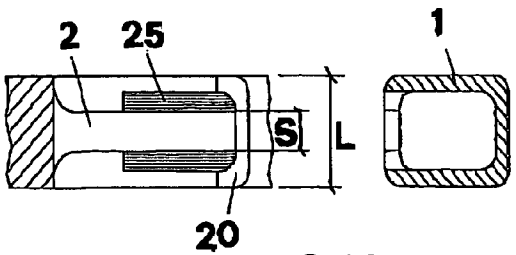
FIG. 36 illustrates a cross-sectional view of the web of the hanger of FIG. 34 relative to the cross-section of the indicator block of FIG. 34.

The slot 12 ends with two openings 13 whose width "G" corresponds to the distance between the two opposite internal walls of the block in order to form a seat for guiding keys 22,23 (see FIG. 23) on the thin web 21; the guiding keys are further described below.

The slot 12 is interrupted, preferably in the central position, by the bridge 14 that acts as a means for locking the indicator block 1 to the web 2 of the support 3 as well as a strengthening and stiffening element of the body of the indicator block 1.

Referring to FIGS. 9 to 13, wherein like reference characters indicate like parts as above, the bridge 14.2 may be placed inside the body, preferably close to the wall equipped with the slot 12 in order to increase the stiffening of the body. The bridge 14.2 thus extends between the walls and behind flanges of the indicator body 1.

Figures 14, 15, 16, 17:
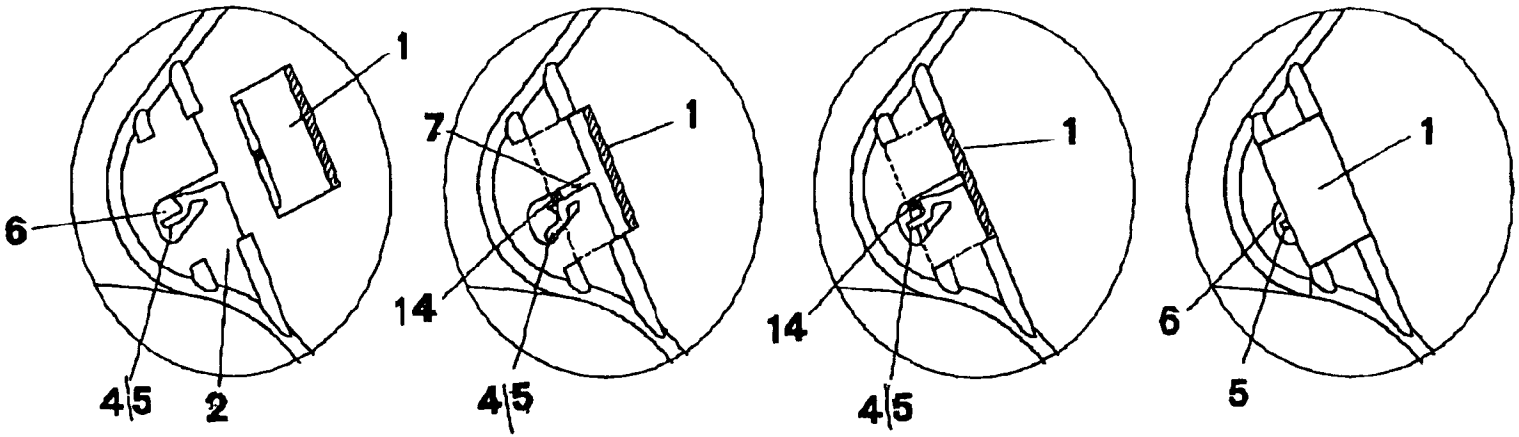
FIGS. 14 to 17 illustrate, in sequence, the attachment steps for mounting the indicator block of FIG. 1 on the web of FIG. 1.
Figures 18, 19, 20, 21:
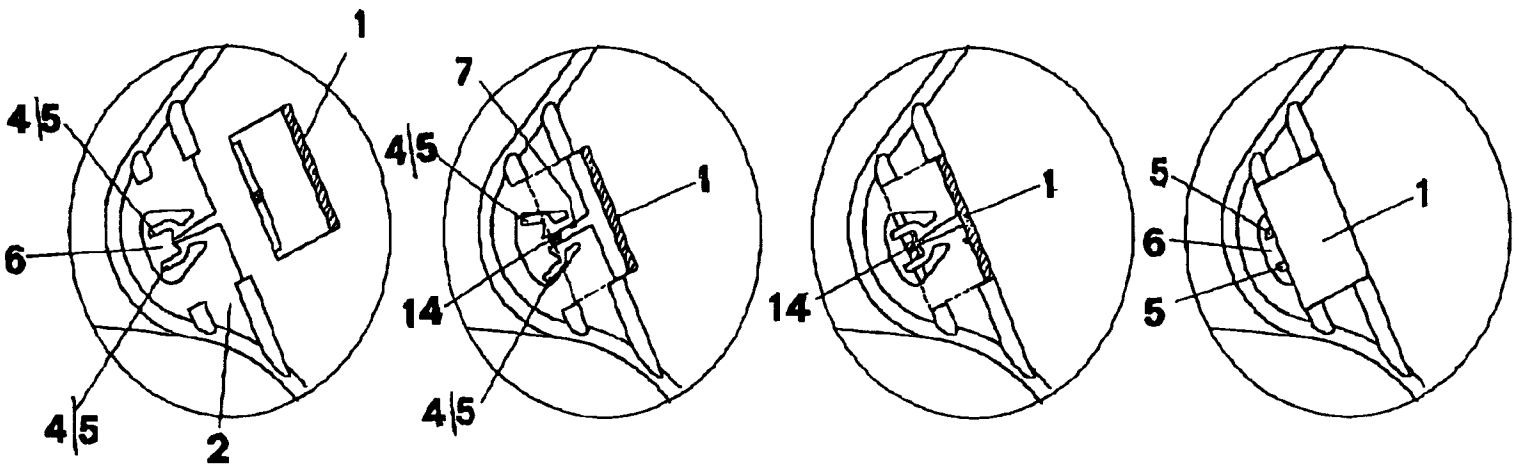
FIGS. 18 to 21 illustrate, in sequence, the attachment steps for mounting the indicator block of FIG. 1 on a web having a pair of locking tabs in accordance with the invention.
Figure 22:
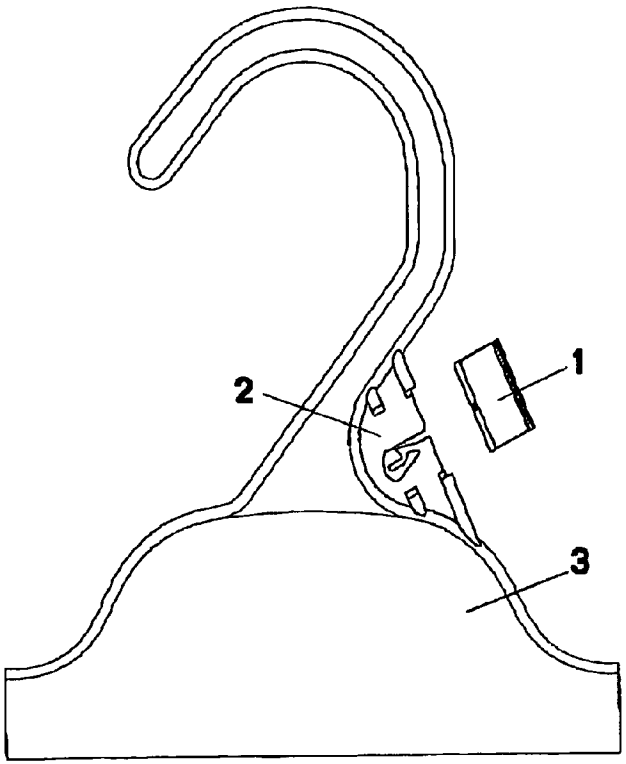
FIG. 22 illustrates an exploded view of the hanger and indicator block of FIG. 1.

As can be deduced from the sequence of FIGS. 14 to 17, when the indicator block 1 is to be mounted in place, the bridge 14 of the block 1 is aligned with a slot 7 in the web 2 that opens into the space 6 (FIG. 14). The indicator block 1 is then slid onto the web 2 with the bridge 14 passing through the slot 7 while moving the tab 4 from an initial position to a retracted position (FIG. 15). Continued movement of the indicator block 1 causes the bridge 14 to pass beyond a shoulder on the tab 4 thereby allowing the tab to spring back to its initial position (FIG. 16). At this time, the shoulder of the tab 4 prevents the bridge 14 from moving back through the slot 7 thereby locking the indicator block 1 on the web 3. In addition, the cover of the indicator block 1 rests on the web 3 and the walls of the indicator block 1 cover over a substantial portion of the space 6 leaving only a small end 5 of the tab 4 exposed (FIG. 17).

The movement of the bridge 14 stops when the bridge 14 moves past the shoulder of the tab 4 and is therefore blocked by the spring back of the tab 4.

Referring to FIG. 2, removal of the block 1 from the web 2 is made possible by inserting a pointed end of a tool "K" into the exposed space 6 against the projecting tab end 5 in order to move the tab laterally from the rest position towards the retracted unlocking position of FIG. 15. At the same time, the tool K wedges between the block 1 and the web 2 to push the block 1 along the web 2. This also causes the bridge of the block 1 to pass through the slot 7 (see FIG. 15) so that the block 1 can be removed from the web 2.

Figure 43:
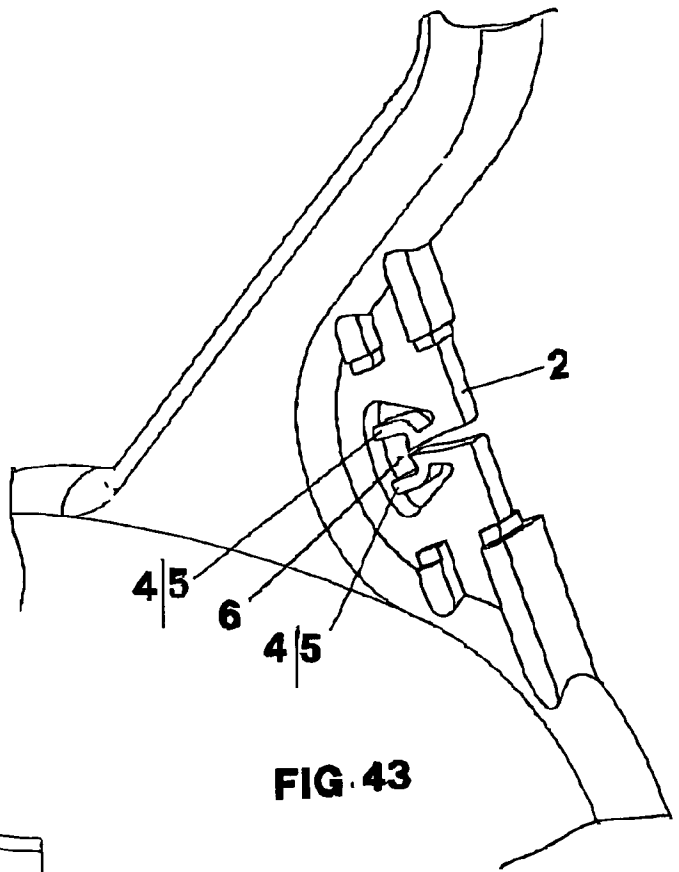
FIG. 43 illustrates an enlarged view of FIG. 42.
Figure 42:
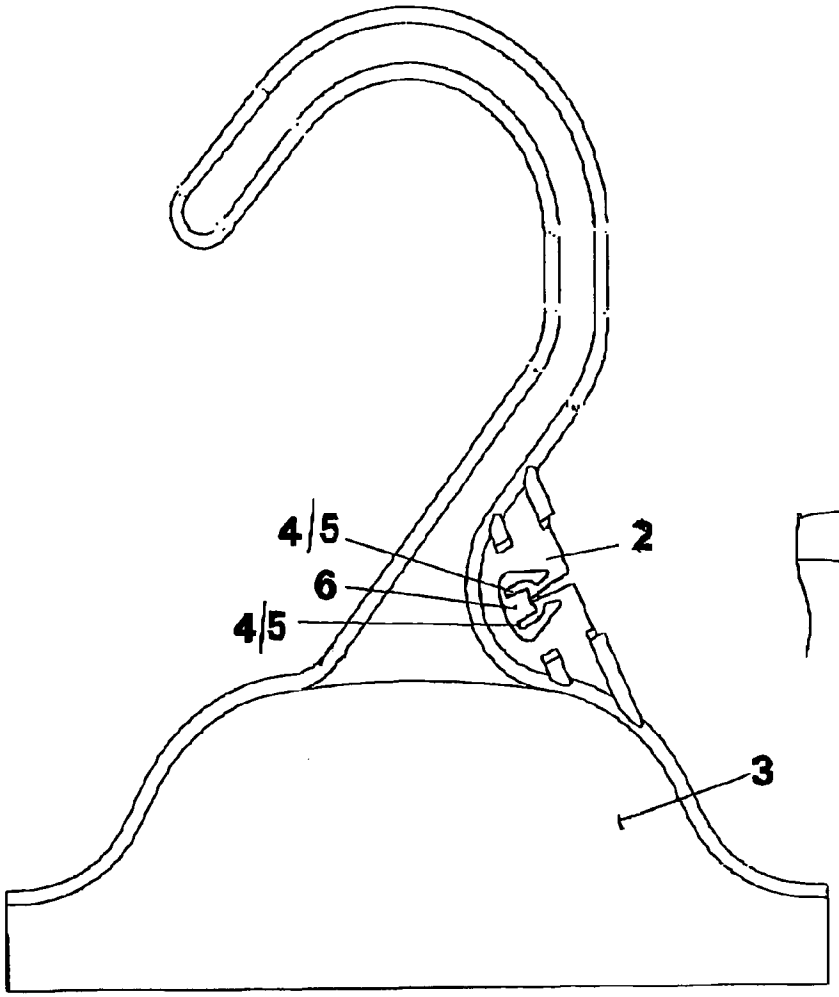
FIG. 42 illustrates a partial perspective view of a hanger employing two locking tabs in accordance with the invention.

Referring to FIGS. 42 and 43, wherein like reference characters indicate like parts as above, the web 2 may have a pair of tabs 4 disposed on opposite sides of the space 6 and the slot leading to the space 6. Mounting of a block 1 on such a web 2 is carried out as indicated by FIGS. 18-21. In this respect, as the bridge of the block 1 moves through the slot, both tabs 4 are moved laterally (FIG. 19) out of the way and are then sprung back (FIG. 20) after the bridge passes by in order to lock the block 1 on the web 2. In order to remove the block, the tool K is used as above to deflect both tabs laterally thereby unlocking the bridge and moving the block 1 along the web 2.

Referring to FIGS. 22 to 25, in a first embodiment, the web 2 is provided with two opposite pairs of ribs 20 and 21 that are of a width "L" greater than the thickness "S" of the thin web 2 and at least equal or greater than the width of the block 1. These ribs 20,21 form upper and lower support and guiding bases for the block (see FIGS. 24 and 25).

As shown in FIGS. 22 to 25, small keys 22, 23 project from the two pairs of ribs 20, 21 and the web 2 and are sized to pass into the openings 13 of the block 1 in order to slidably receive the block 1. These keys 22,23 engage the front entry guide (key 22) and the rear anti-rotation guide (key 23) of the block 1 during mounting of the block 1 onto the thin web 2.

FIGS. 26 to 29, wherein like reference characters indicate like parts as above, represent a second embodiment of a support seat for the indicator block 1 on the web 2, wherein there are only the front ribs 20 and the front keys 22.

FIGS. 30 to 33, wherein like reference characters indicate like parts as above, represent a third embodiment of the support seat for the indicator block 1, wherein there are front ribs 20, front keys 22 and some bosses 24 with anti-rotation functions on the web 2 that slidably receive the block 1.

Figure 37:
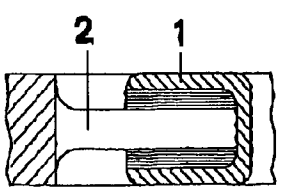
FIG. 37 illustrates a cross-sectional view of the web of the hanger of FIG. 34 with the indicator block of FIG. 34 mounted in place.
Figure 39:
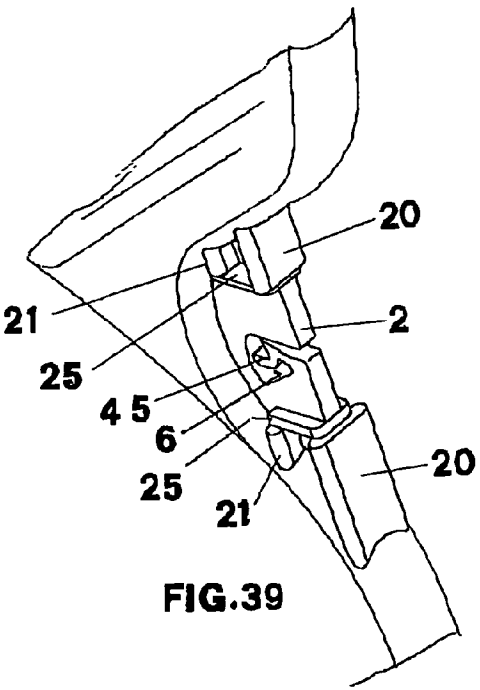
FIG. 39 illustrates a partial perspective view of the hanger of FIG. 38.
Figure 41:
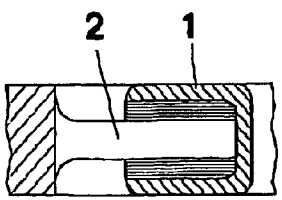
FIG. 41 illustrates a cross-sectional view of the web of the hanger of FIG. 38 with the indicator block of FIG. 38 mounted in place.
Figure 38:
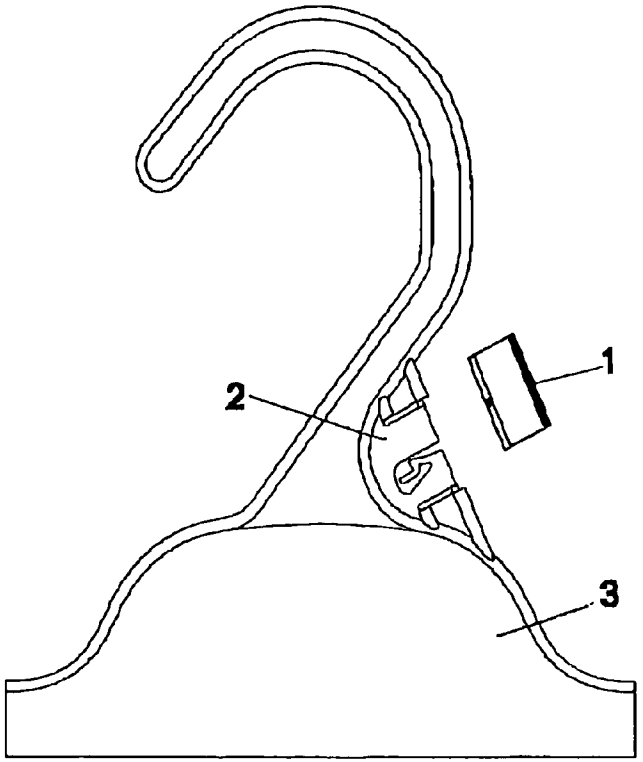
FIG. 38 illustrates an exploded view of a further modified hanger and the indicator block of FIG. 1.
Figure 40:
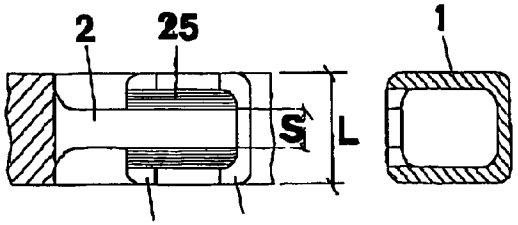
FIG. 40 illustrates a cross-sectional view of the web of the hanger of FIG. 38 relative to the cross-section of the indicator block of FIG. 38.

FIGS. 34 to 37, wherein like reference characters indicate like parts as above, represent a fourth embodiment of the support seat for the indicator block 1, wherein the two pairs of guiding keys are replaced by two opposite strips 25 that close the two ends of the block 1 and fit within the ends of the block 1 (see FIG. 37). Each strip 25 extends from a respective rib 20 along the web 2 and has a respective wall of the block 1 slidably mounted thereon.

FIGS. 38 to 41, wherein like reference characters indicate like parts as above, represent a fifth embodiment of the support seat of the small indicator block 1 wherein rear ribs 21 extend perpendicularly from the ends of the strips 25 o the web 2.

Figure 44:
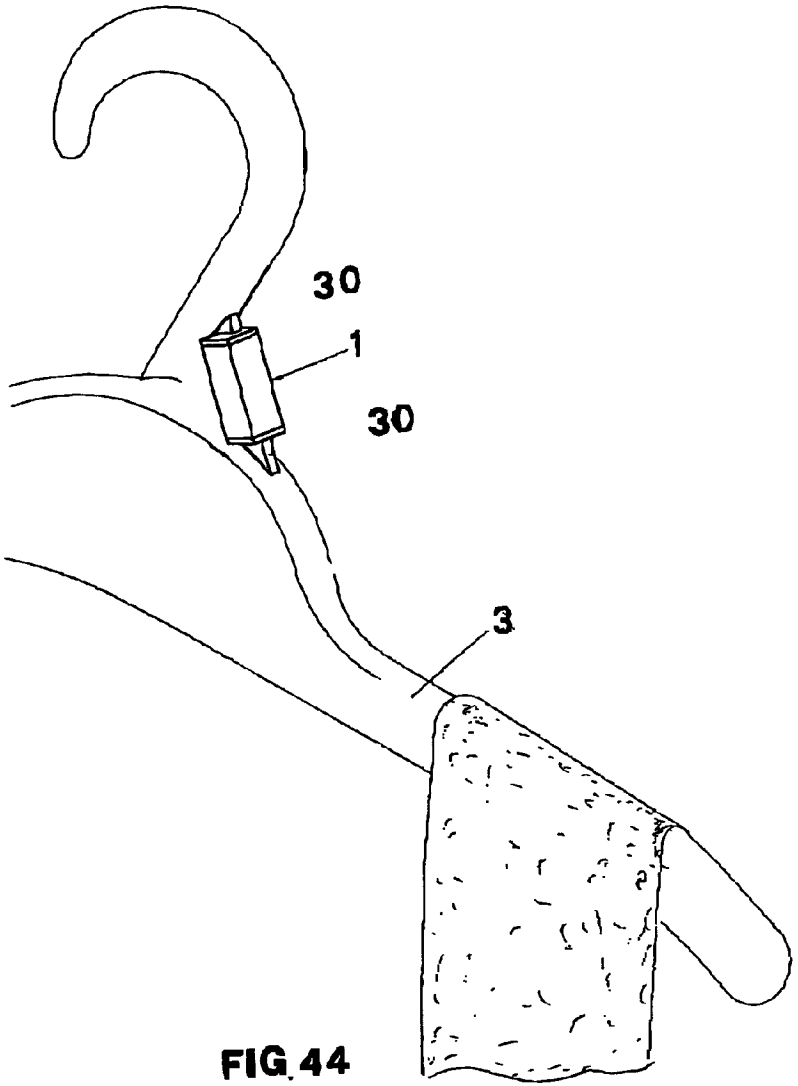
FIG. 44 illustrates a perspective view of a coat hanger equipped with a small indicator block of the invention.

FIG. 44 represents a small indicator block 1 integrally assembled on the web of a support 3 in the form of a hanger.

When assembled the block 1 may be removed only with a difficult action compromising its integrity and therefore does not allow its reuse.

Figure 46:
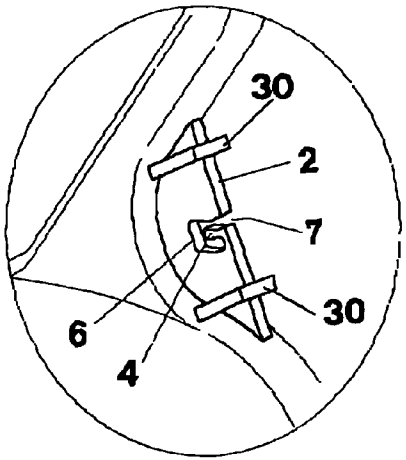
FIG. 46 illustrates a perspective view of the support of FIG. 44 with the indicator block removed.
Figure 47:
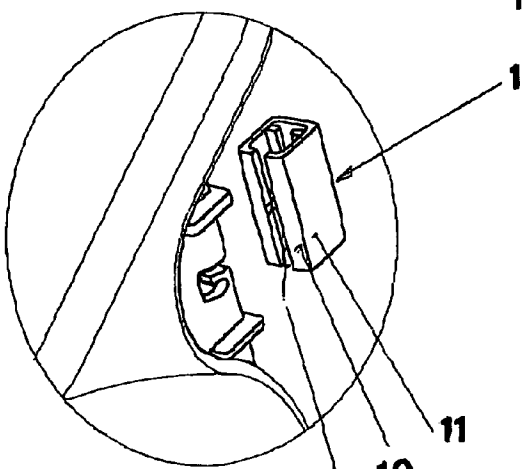
FIG. 47 illustrates an exploded view of the web and indicator block of FIG. 45.
Figure 45:
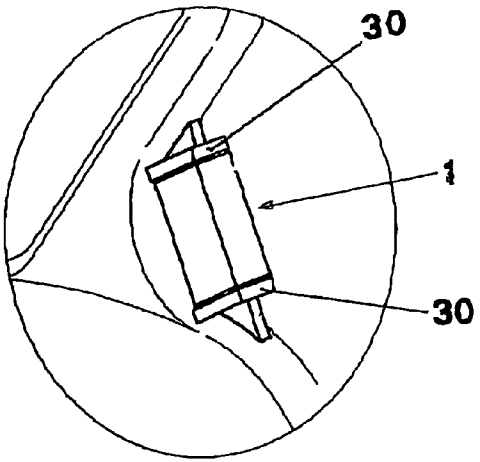
FIG. 45 illustrates a part perspective view of the indicator block of FIG. 44 mounted in place.

Referring to FIGS. 45 to 47, wherein like reference characters indicate like parts as above, in order to make removal of the block 1 from the web 2 difficult to ill-disposed people, the web 2 is provided with two walls 30 each of a size equal to the outside contour of the block 1 so that when the block 1 is mounted in place between the walls 30, the block 1 is entirely contained between two opposite walls 30.

Figures 48, 49, 50:
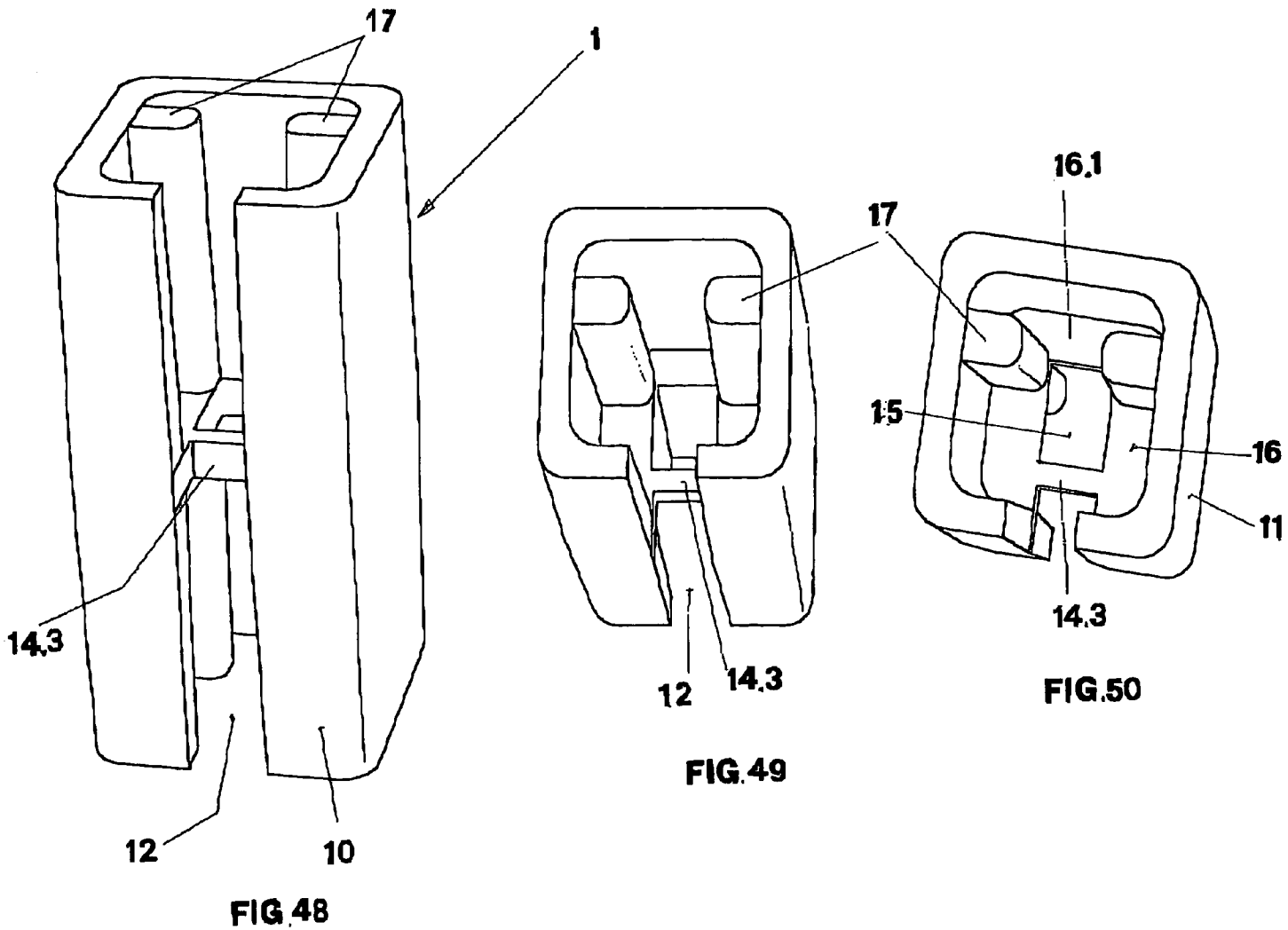
FIG. 48 illustrates a perspective view of a modified indicator block with an apertured transverse rib recessed within the block to define the bridge in accordance with the invention.
FIG. 49 illustrates a further perspective view of the indicator block of FIG. 48.
FIG. 50 illustrates a still further perspective view of the indicator block of FIG. 48.

Referring to FIGS. 48 to 50, wherein like reference characters indicate like parts as above, in order to avoid a possible breaking, the small indicator block 1 is made of a hollow body 11 with a longitudinal slot 12 that extends the length of the block 1 and a transverse stiffening rib 16 that extends between and transversely of the walls. The stiffening rib 16 has an aperture 15 and a bridge 14.3 that is integral with the rib 16 and defines a side of the aperture 15. Additional ribs 17 extend from an upper end 16.1 of the stiffening rib 16 integrally with the block 1 and in opposite directions to enhance the longitudinal stiffening of the block 1.

Referring to FIGS. 51 to 53 and FIGS. 54 to 56, the mounting of the block 1 of FIG. 48 on a web 2 is such that the walls of the block completely cover the space 6 in which the tab 4 (FIG. 53) or tabs 4 (FIG. 56) are located so that the tab(s) are recessed within the plane of the walls of the block 1. Thus, the ends 5 of the tab(s) 4 are not exposed.

Figures 51, 52, 53, 54, 55, 56:
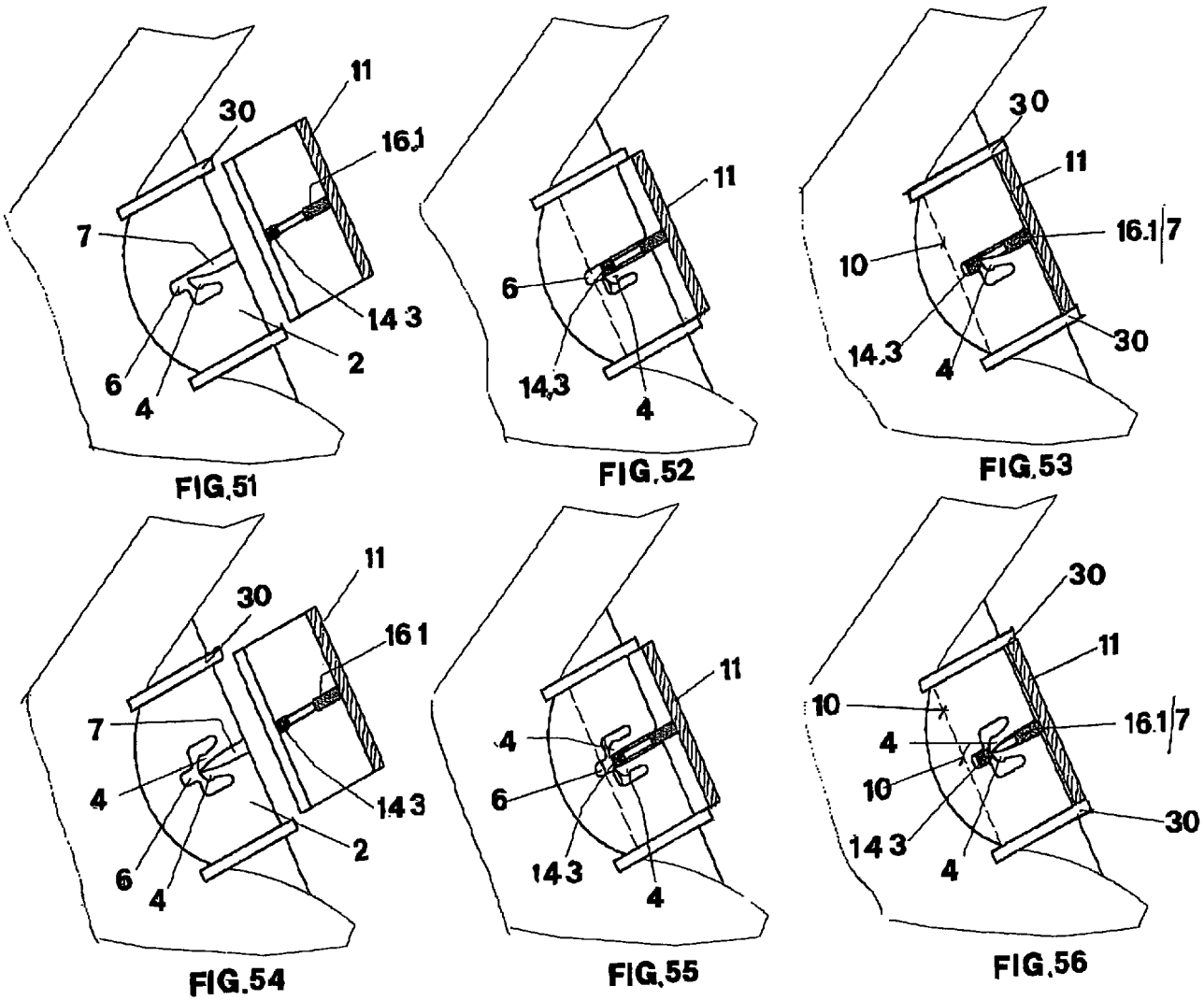
FIGS. 51 to 53 illustrate, in sequence, the attachment steps for mounting the indicator block of FIG. 48 on the rib of FIG. 46.
FIGS. 54 to 56 illustrate, in sequence, the attachment steps for mounting the indicator block of FIG. 48 on a rib with a pair of locking tabs.

As can be seen in FIGS. 53 and 56, in order to make breaking of the small block 1 even more difficult, the rear portion 16.1 of the stiffening rib 16 is disposed in the slot 7 leading into the space 6 and further increases the resistance to breaking.

Figure 58:
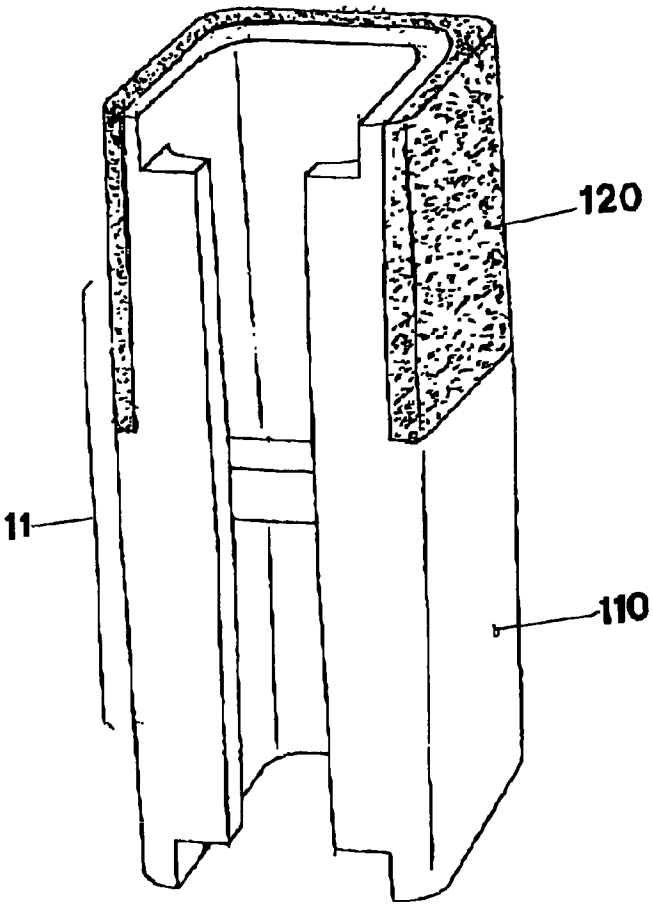
FIG. 58 illustrates a perspective view of a further indicator block made by co-injection or post-injection of two different components.
Figure 57:
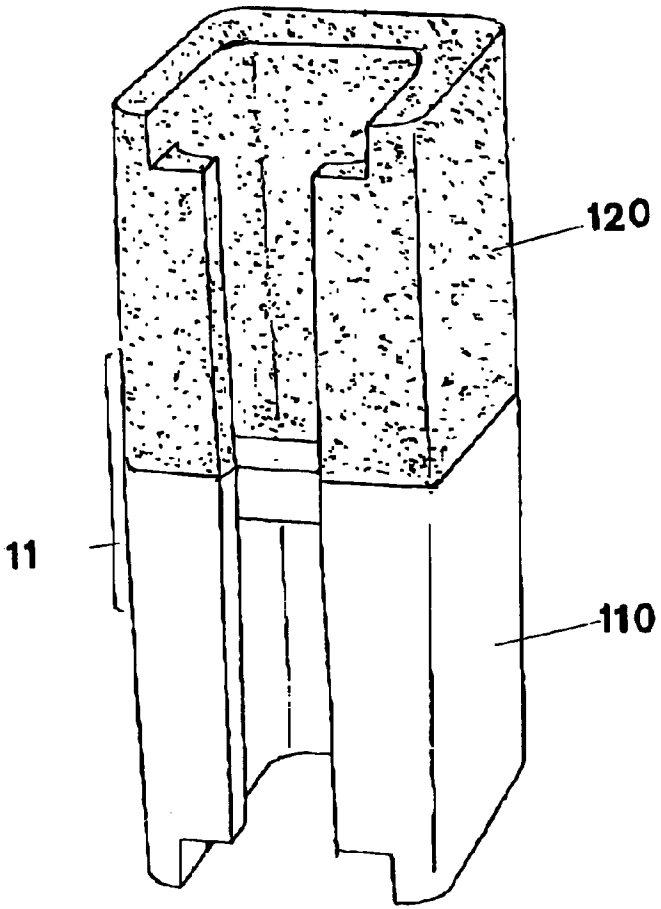
FIG. 57 illustrates a perspective view of an indicator block made by co-injection or post-injection of two different components.

Referring to FIG. 57, the body 11 of the small indicator block may be made of a block-like shape 11 with a first coaxial portion 110 of a different material from a second coaxial portion 120. Also, as shown in FIG. 58, the block may be made of a block-like shape 11 with a first main portion 110 of a different material from a second portion 120 that covers a section of the main portion. These bi-component indicator blocks may be made by co-injection or post-injection.

The invention thus provides a block that can be mounted on a hanger or other suitable support in a manner that prevents manual removal by use of a finger or fingernail.

Further, the invention provides a block that can be mounted on a hanger or other suitable support in a permanently locked manner or in a locked manner that allows removal with a tool with a pointed end.

The invention further provides a sizer block for a hanger that has enlarged surfaces to provide for an increased area for printing of information thereon.

What is claimed is:

1. An indicator block having a pair of spaced apart walls defining an opening therebetween;

a cover extending longitudinally of said walls and connecting said walls at one end thereof; and at least one bridge connected to and extending between said walls in spaced relation to said cover, said bridge being of less longitudinal length than said cover and said walls.

2. An indicator block as set forth in claim 1 wherein said walls are disposed in parallel relation to each other and in perpendicular relation to said cover.

3. An indicator block as set forth in claim 2 further having a pair of flanges, each said flange being integral with a respective one of said walls and disposed in facing relation to the other of said pair of flanges.

4. An indicator block having a pair of spaced apart walls disposed in parallel relation to each other and defining an opening therebetween;

a cover connecting said walls at one end thereof and disposed in perpendicular relation to said walls;

a pair of flanges, each said flange being integral with a respective one of said walls and disposed in facing relation to the other of said pair of flanges; and at least one bridge connected to and extending between said flanges in spaced relation to said cover.

5. An indicator block as set forth in claim 3 wherein said bridge extends between said walls and behind said flanges.

6. An indicator block as set forth in claim 2 wherein each of said walls and said cover has a flat surface receiving printing thereon.

7. An indicator block as set forth in claim 6 wherein said printing is in Arial font.

8. An indicator block as set forth in claim 6 wherein at least one of said walls has a flat surface having a length of 18.2 millimeters and a width of 10.5 millimeters.

9. An indicator block as set forth in claim 1 wherein said bridge is recessed within the plane of said walls.

10. An indicator block as set forth in claim 1 further having a transverse stiffening rib extending between and transversely of said walls.

11. An indicator block as set forth in claim 10 wherein said stiffening rib has an aperture therein and said bridge is integral with said rib and defines a side of said aperture.

12. An indicator block as set forth in claim 10 further having a plurality of auxiliary stiffening ribs integral with said transverse rib and said walls.

13. An indicator block as set forth in claim 1 further having a block-like shape with a first portion of a different material from a second portion thereof.

14. An indicator block having a pair of parallel walls defining an opening therebetween;

a cover transverse to and connecting said walls at one end thereof;

a pair of flanges each said flange extending perpendicularly of a respective one of said walls and disposed in facing relation to the other of said pair of flanges; and at least one bridge connected to and extending between said walls in spaced relation to said cover.

15. An indicator block as set forth in claim 14 wherein said bridge extends between flanges.

16. An indicator block as set forth in claim 14 wherein said bridge extends between said walls and behind said flanges.

17. An indicator block as set forth in claim 14 further having a transverse stiffening rib extending between and transversely of said walls.

18. An indicator block as set forth in claim 17 further having a plurality of auxiliary stiffening ribs integral with said transverse rib and said walls.

19. An indicator block as set forth in claim 14 further having a block-like shape with a first portion of a different material from a second portion thereof.

20. In combination, a support having a web with a space therein and at least one resilient tab extending into said space for movement in the plane of said web between a first position and a second position; and an indicator block mounted on said web, said block having a pair of spaced apart walls disposed on opposite sides of said web and covering at least a portion of said recess and said tab and at least one bridge connected to and extending between said walls, said bridge being disposed in locking engagement with said tab in said first position and in unlocked position with said tab in said second position.

21. The combination as set forth in claim 20 wherein said walls of said block cover over said tab and said bridge is recessed within the plane of said walls.

22. The combination as set forth in claim 20 wherein said tab projects beyond said walls whereby insertion of a pointed tool perpendicularly into said space and against said tab causes movement of said tab from said first position to said second position for unlocking of said block.

23. The combination as set forth in claim 20 wherein said web has a pair of said tabs disposed in opposed relation within said space and said bridge of said block is received between said tabs.

24. The combination as set forth in claim 20 wherein said block has a cover connecting said walls at one end thereof.

25. The combination as set forth in claim 24 wherein said support has a pair of ribs mounted on said web and receiving said cover of said block therebetween and a pair of keys each said key extending from a respective rib and having a respective wall of said block slidably mounted thereon.

26. The combination as set forth in claim 24 wherein said support has a pair of ribs mounted on said web and receiving said cover of said block therebetween and a pair of strips, each said strip extending from a respective rib along said web and having a respective wall of said block slidably mounted thereon.

27. The combination as set forth in claim 24 wherein said support has two pairs of ribs extending from said web and guiding said block therebetween, each said pair of ribs being spaced from the other of said pair of ribs.

28. The combination as set forth in claim 27 wherein each said rib has a key extending therefrom and having a respective wall of said block slidably mounted thereon.

29. The combination as set forth in claim 20 wherein said support is a hanger.

30. In combination, a hanger having a web with an internally disposed tab for movement in the plane of said web between a first position and a second position; and a size indicator mounted on said web, said size indicator having a pair of walls disposed on opposite sides of said web and means extending from at least one of said walls for locking engagement with said tab in said first position.

31. The combination as set forth in claim 30 wherein said means is a bridge extending between said walls.

32. The combination as set forth in claim 30 wherein said walls of said block cover over said tab and said means is recessed within the plane of said walls.

33. The combination as set forth in claim 30 wherein said tab projects beyond said walls whereby insertion of a pointed tool perpendicularly into said space and against said tab causes movement of said tab from said first position to said second position for unlocking of said sizer.

34. An indicator block having a pair of spaced apart walls defining an opening therebetween;

a cover extending longitudinally of said walls and connecting said walls at one end thereof; and at least one bridge connected to and extending between said walls transversely of said opening and in spaced relation to said cover and with an uninterrupted space between said cover and said bridge, said bridge being of less longitudinal length than said cover.

35. In combination, a support having a web with a space therein and at least one resilient tab extending into said space for movement in the plane of said web between a first position and a second position; and an indicator block mounted on said web, said block having a pair of spaced apart walls disposed on opposite sides of said web and covering at least a portion of said recess and said tab and at least one bridge connected to and extending between said walls with an uninterrupted space between said cover and said bridge, said bridge being disposed in locking engagement with said tab in said first position and in unlocked position with said tab in said second position.

* * * * *

UNITED STATES PATENT AND TRADEMARK OFFICE

CERTIFICATE OF CORRECTION

PATENT NO. : 7,380,359 B2
APPLICATION NO. : 10/767097
DATED : June 3, 2008
INVENTOR(S) : Mario Mainetti It is certified that error appears in the above-identified patent and that said Letters Patent is hereby corrected as shown below:

Title Page insert
(30) Foreign Application Priority Data
Mar. 19, 2003 (I.T.) . . . V12003A000053
APR. 10, 2003 (I.T.) . . . V12003A000071

Signed and Sealed this

Fifth Day of August, 2008

JON W. DUDAS
*Director of the United States Patent and Trademark Office*